United States Patent [19]

Pennington-Ridge

[11] Patent Number: 5,008,780

[45] Date of Patent: Apr. 16, 1991

[54] ILLUMINATING DEVICE

[76] Inventor: Patrick A. Pennington-Ridge, 19 Staple, West Quantoxhead, Williton, Taunton, Somerset TA4 4DQ, United Kingdom

[21] Appl. No.: 485,535

[22] Filed: Feb. 27, 1990

Related U.S. Application Data

[63] Continuation of Ser. No. 311,468, Feb. 16, 1989, abandoned.

[51] Int. Cl.[5] ..... F21K 2/00

[52] U.S. Cl. ..... 362/34; 362/322; 362/282; 116/202

[58] Field of Search ..... 362/202, 84, 34, 154, 362/217, 277, 282, 283, 319, 321, 322; 40/431; 116/202, 206

[56] References Cited

U.S. PATENT DOCUMENTS

| | | | |
|---|---|---|---|
| 2,365,342 | 12/1944 | Hilliard et al. | 362/322 |
| 2,935,041 | 5/1960 | Rovere | D26/11 X |
| 3,884,560 | 5/1975 | Neylan et al. | 362/34 |
| 4,104,708 | 8/1978 | Bohli | 362/34 |
| 4,417,299 | 11/1983 | Rupp | 362/190 |
| 4,425,599 | 1/1984 | Rieder et al. | 362/322 |

*Primary Examiner*—Stephen F. Husar
*Assistant Examiner*—D. M. Cox
*Attorney, Agent, or Firm*—Plante, Strauss, Vanderburgh & Connors

[57] ABSTRACT

An illuminating device comprises a tubular outer sleeve (12) provided with an elongated transparent window (13), with an inner sleeve (22) formed with an aperture (27). The inner sleeve (22) houses a pair of self-luminous light sources (30). Relative rotation between the inner and outer sleeves (22, 12) determines the shape illustrated by the sources (30) and visible through the window (13). The inner sleeve (22) thus serves as a shutter in controlling light emission.

12 Claims, 2 Drawing Sheets

ILLUMINATING DEVICES

REFERENCE TO RELATED APPLICATIONS

This application is a continuation of my parent application, Ser. No. 311,468, filed Feb. 16, 1989, now abandoned.

BACKGROUND TO THE INVENTION

This invention relates to illuminating devices and is particularly concerned with portable illuminating devices for providing either selected illuminated shapes or a source of light.

SUMMARY OF THE INVENTION

According to the invention, an illuminating device comprises a tubular sleeve provided with a window, a shutter member rotatable within the sleeve, at least one aperture formed in the shutter member and at least one light source disposed internally of the shutter member, whereby relative rotation of the shutter member and the sleeve changes the shape that is illuminated through the window.

Preferably, the shutter member comprises an inner sleeve. The first-mentioned sleeve then becomes an outer sleeve.

The light source preferably comprises one or more self luminous light sources and the light sources may be attached to a pillar extended internally of the inner sleeve and formed integral with a cover closing an upper end of the device.

Preferably, the cover is provided with a clip member to facilitate attachment of the device and may have a peripheral shape comprising a number of flat portions to prevent rolling of the device when it is placed on a surface.

An upper end surface of the outer sleeve may be attached to an internal surface of the cover portion, and may be formed with an internal groove for engagement by a flange portion at an upper end of the inner sleeve.

A lower end of the inner sleeve may be used to close the other end of the device and may include a radially extending flange portion by which relative rotation of the inner and outer sleeves is achieved.

BRIEF DESCRIPTION OF THE ACCOMPANYING DRAWINGS

The invention will now be described by way of example only, with reference to the accompanying drawings, wherein:

FIG. 1 is a perspective view of an illuminating device constructed according to the invention, FIG. 2 is a side view of a tubular outer sleeve part of the device of FIG. 1, FIG. 3 is a side view of a tubular inner sleeve part of the device of FIG. 1, FIG. 4 is a side view of a light source holder and cover portion of the device of FIG. 1, FIG. 5 is a sectional view taken on lines A—A of FIG. 4, FIG. 6 is a sectional view, similar to the arrangement of FIG. 5, which view illustrates one modification, and FIG. 7 is a view which illustrates another modification.

DETAILED DESCRIPTION OF THE PREFERRED EMBODIMENT

Figure 1:
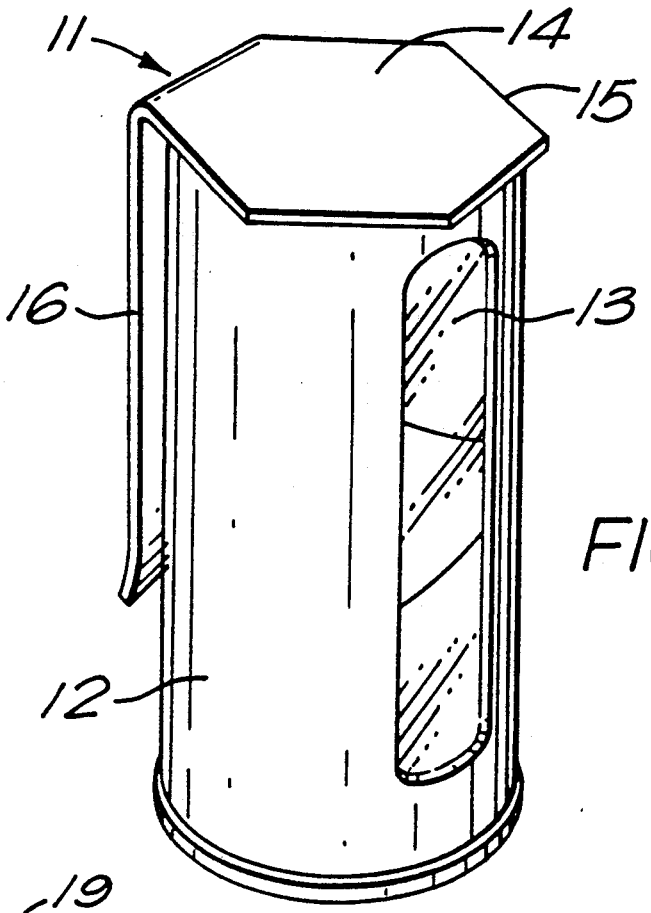

With reference to the figures, the illuminating device 11 illustrated thereby comprises a tubular outer sleeve 12 provided with a longitudinally extending transparent elongated window portion 13. A shutter member comprising a tubular inner sleeve 22 is disposed coaxially within the outer sleeve and is rotatable relative thereto. A cover portion 14 having a hexagonal peripheral shape 15 closes one end of the outer sleeve 12 and is provided with a clip member 16 to facilitate attachment of the device 11 to a person.

The illuminating device 11 is constructed of resilient plastics material.

Figure 2:
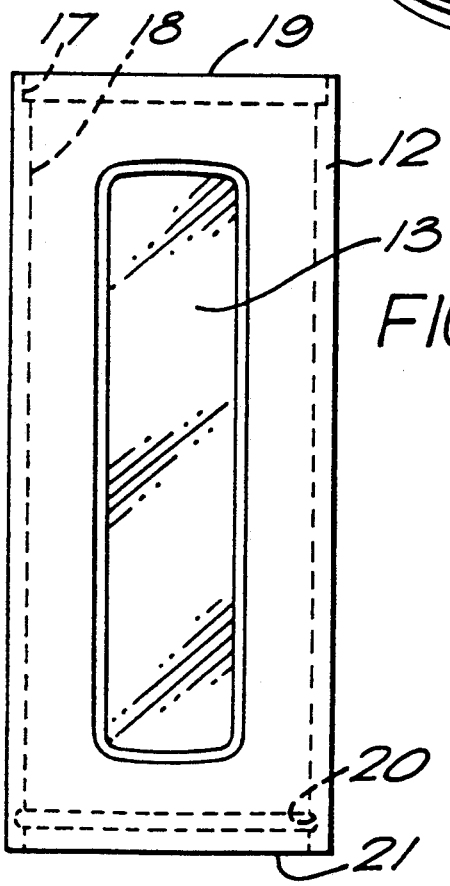

As shown in more detail in FIG. 2, the outer sleeve 12 which incorporates the window 13, is open at both ends. A first internal groove 17 is formed on the inner (wall) surface 18 of the sleeve 12 at an upper end 19 thereof. A second internal groove 20 is formed on the inner (wall) surface 18, spaced inwardly from a lower end 21 of the sleeve.

Figure 3:
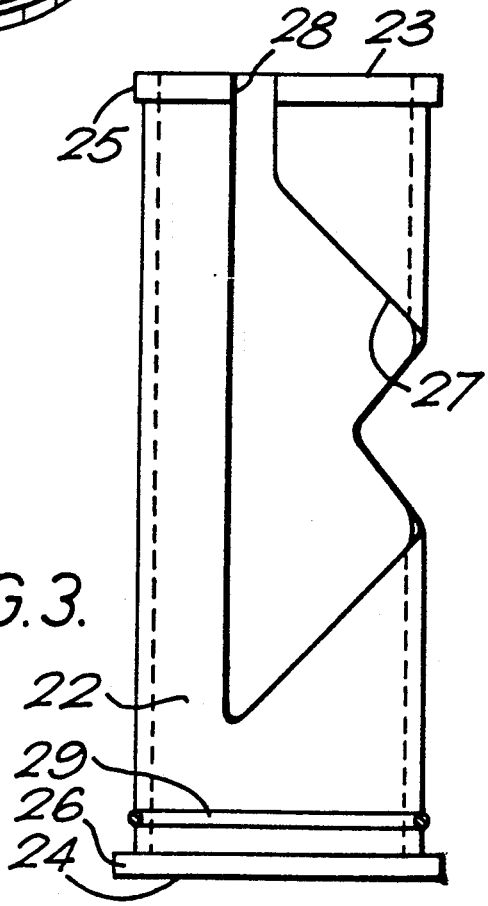

The tubular inner sleeve 22 (FIG. 3) has an open upper end 23 and a closed lower end 24. Radially extending flanges 25 and 26 respectively are located at the upper and lower ends 23, 24 of the inner sleeve 22.

An aperture 27 having a predetermined shape and for a purpose hereinafter described, is formed in the wall of the inner sleeve 22, and is extended by a slot 28 through its upper end 23. An O-ring 29 is located in a peripheral groove adjacent the lower end of the inner sleeve 22.

Two longitudinally extending self luminous visible light sources 30 of elongate form, such as are manufactured by Saunders-Roe Developments Limited under the Trade Mark "BETALIGHT", are adhered or otherwise secured to the surface of a pillar 31 which is formed integral with the top cover 14, and extending generally perpendicularly downwardly therefrom. Betalights consist of sealed glass capsules internally coated with phosphor and filled with tritium gas which activates the phosphor to produce light. Two concentric integral flanges 32 and 33 are formed on a lower surface of the cover 14.

In assembly of the illuminating device 11, the slot 28 enables the upper end 25 of the resilient inner sleeve 22 to be squeezed to permit its location through the lower end 21 of the outer sleeve 12. When the sleeve 22 is fully inserted, the flange 25 of the sleeve snaps outwardly into engagement with the groove 17 at the upper end 19 of the outer sleeve 12. The sleeves 12 and 22 are then retained in coaxial relationship with each other.

The pillar 31 is located internally of inner sleeve 22 and the assembled upper ends 19 and 23 are located between the flanges 32 and 33. The outer sleeve 12 is ultrasonically welded to the cover 14 so as to seal the upper end of the device 11.

The O-ring 29 locates in the groove 20 so as to seal the lower end of the device 11 and prevent the ingress of dirt or moisture.

Relative rotation of the inner and outer sleeves 12 and 22 is effected by rotating the bottom flange 26. It will be apparent that the inner sleeve 22 serves as a shutter during such rotation so as to determine the shape that is illuminated by the light sources 30 and visible through the window 13.

The shape of the aperture 27 in the illustrated embodiment provides four operating positions of the device 11. From a position in which no light is visible through window 13, rotation of the inner sleeve 22 serves firstly to display a narrow vertical band of light and further rotation serves to allow light to be emitted from the entire window area so as to enable the device 11 to serve as a torch.

Further rotation serves to illuminate a pointed shape usable as a direction indicator and yet further rotation returns the device to the effective OFF position in which no light is visible.

As an alternative, or as an addition to the visible light source(s) 30, one or more light sources may be used which emit non-visible light. That is to say, light which is not visible to the naked eye.

Figure 4:
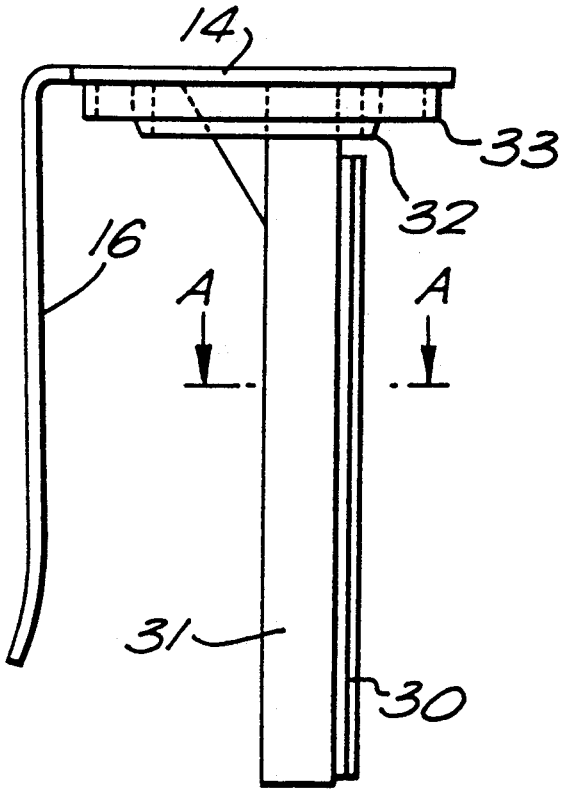
Figure 5:
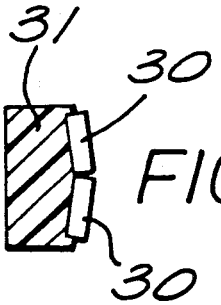
Figure 6:
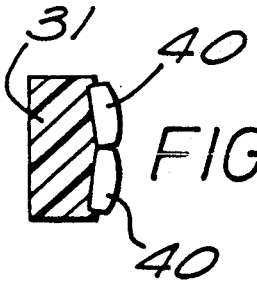

FIG. 6 illustrates such a modification wherein visible light sources 30 (of FIGS. 4 and 5) have been replaced by a pair of light sources 40 which emit light on an infra-red wavelength. The light sources 40 become visible when viewed with special equipment such as night vision goggles.

In a non-illustrated modification, one of the visible light sources 30 shown in FIG. 5 is replaced by a non-visible light source 40, so that the device 11 is then provided with both visible and non-visible light sources, disposed side by side.

Figure 7:
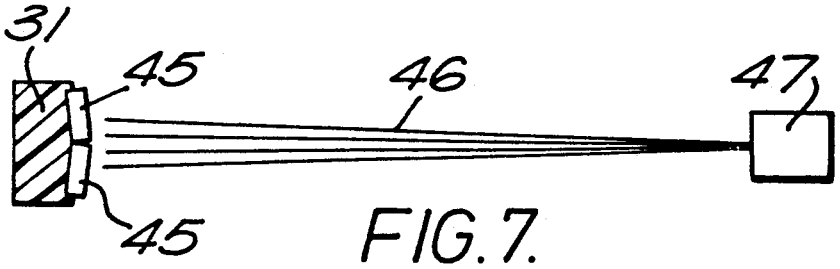

In the modification illustrated by FIG. 7, the device 11 has light sources 45, (visible or non-visible to the naked eye), which remain passive, that is, non light emitting until triggered to an active mode by receipt of an interrogatory signal. Such a signal may take the form of a (visible or non-visible) light or radio beam signal 46 emitted by a controllable source 47.

When this modification is in use, the shutter member/sleeve 22 is left open to admit access of the beam signal 46.

Whilst one embodiment and modification have been described and illustrated, it will be apparent that many further modifications may be made without departing from the scope of the invention. For example, the shape of aperture 27 can be selected to provide other desired indicated shapes as the inner sleeve is rotated, and may comprise a series of round or other shape apertures to provide a desired display sequence as relative rotation occurs. Any suitable alternative light source may be incorporated such as one or more light emitting diode (LED) sources which may be powered from a miniature battery located within the device. In such an arrangement switch means may be incorporated and may be arranged to be automatically operated during the relative rotation of the inner and outer sleeves so as to switch off the power to the light source when the device is in the OFF position, thereby conserving battery power.

The flat portions of the hexagonal shape 15 prevent rolling of the device 11 when it is placed on a substantially horizontal or slightly sloping surface.

The light sources 40 and 45, like sources 30, are of elongate form.

I claim:

1. An illuminating device comprising an outer tubular sleeve provided with a window, an inner tubular sleeve, rotatable coaxially within the outer sleeve, at least one aperture formed in the inner sleeve, and at least one self luminous light source of elongated form disposed within the inner sleeve and longitudinally thereof, the aperture formed in said inner sleeve having an axially elongate portion extending substantially parallel to the axis of rotation of the inner sleeve and another portion of the aperture having a tapered cross configuration and lesser axial length than said axially elongate portion and extending laterally thereof, whereby relative rotation of the inner and outer sleeves to reduce the axial length of the light that is illuminated through the window without reduction of the width thereof.

2. A device as claimed in claim 1, wherein the self luminous light source comprises a sealed transparent capsule internally coated with phosphor and filled with a gas which activates the phosphor to produce light.

3. A device as claimed in claim 1, provided with a clip member to facilitate attachment of the device.

4. A device as claimed in claim 1, wherein the upper end of said outer sleeve is sealed to an internal surface of a cover portion permanently closing the device.

5. A device as claimed in claim 1, wherein said inner sleeve has an outerly extending flange about its upper end, and the upper end of the said outer sleeve has a coacting internal groove to receive said outwardly extending flange thereby permanently interlocking said outer and inner sleeves.

6. A device as claimed in claim 5 wherein said including an annular seal between said inner sleeve and said outer sleeve and located at the lower ends of said sleeves.

7. A device as claimed in claim 1, wherein the lower end of the inner sleeve closes a lower end of the device and includes a radially extending distal flange by which relative rotation of the inner and outer sleeves is achieved.

8. A device as claimed in claim 1, provided with at least one light source which emits non-visible light.

9. An illuminating device comprising an outer tubular sleeve provided with a window, an inner tubular sleeve, rotatably coaxially within the outer sleeve and having an outerly extending flange about its upper end which is received in a coacting internal groove in the upper end of said outer sleeve thereby permanently interlocking said outer and inner sleeves, an annular seal between said inner sleeve and said outer sleeve and located at the lower ends of said sleeves, a cover portion permanently closing the device, a seal between the upper end of said outer sleeve and an internal surface of said cover portion, at least one aperture formed in the inner sleeve, and at least one self luminous light source of elongated form disposed within the inner sleeve and longitudinally thereof, the aperture formed in said inner sleeve having an axially elongate portion extending substantially parallel to the axis of rotation of the inner sleeve and another portion of the aperture having lesser axial length than said axially elongate portion and extending laterally thereof, whereby relative rotation of the inner and outer sleeves changes the light that is illuminated through the window.

10. A device as claimed in claim 9, wherein the self luminous light source is attached to a pillar extended internally of the inner sleeve, and said pillar being formed integral with said cover.

11. A device as claimed in claim 10, wherein said cover has two, spaced-apart, concentric annular flanges on its undersurface and wherein the upper ends of said outer and inner sleeves are received between said annular flanges.

12. An illuminating device comprising an outer tubular sleeve provided with a window, an inner tubular sleeve, rotatably coaxially within the outer sleeve, at least one aperture formed in the inner sleeve, a pillar extended internally of the inner sleeve, said pillar being formed integral with a cover closing an upper end of the device and at least one self luminous light source comprising an elongated, sealed transparent capsule internally coated with phosphor and filled with a gas which activates the phosphor to produce light of elongated form disposed within the inner sleeve and longitudinally thereof, the aperture formed in said inner sleeve having an axially elongate portion extending substantially parallel to the axis of rotation of the inner sleeve and another portion of the aperture having lesser axial length than said axially elongate portion and extending laterally thereof, whereby relative rotation of the inner and outer sleeves changes the light that is illuminated through the window.

* * * * *